US010172486B2

(12) United States Patent
Ferraro et al.

(10) Patent No.: US 10,172,486 B2
(45) Date of Patent: Jan. 8, 2019

(54) MULTI-CHAMBERED SHOT CONTAINER

(71) Applicant: Double Take Containers, LLC, Boca Raton, FL (US)

(72) Inventors: Bradley Joseph Ferraro, Delray Beach, FL (US); Thomas Chadwick Colestock, Boca Raton, FL (US); Christian Paul Bhim, Margate, FL (US)

(73) Assignee: Double Take Containers, LLC, Boca Raton, FL (US)

( * ) Notice: Subject to any disclaimer, the term of this patent is extended or adjusted under 35 U.S.C. 154(b) by 0 days.

(21) Appl. No.: 15/579,099

(22) PCT Filed: Jun. 1, 2016

(86) PCT No.: PCT/US2016/035278
§ 371 (c)(1),
(2) Date: Dec. 1, 2017

(87) PCT Pub. No.: WO2016/196639
PCT Pub. Date: Dec. 8, 2016

(65) Prior Publication Data

US 2018/0168375 A1 Jun. 21, 2018

Related U.S. Application Data

(60) Provisional application No. 62/168,947, filed on Jun. 1, 2015.

(51) Int. Cl.
*A47G 19/22* (2006.01)
*B65D 81/32* (2006.01)

(52) U.S. Cl.
CPC ..... *A47G 19/2205* (2013.01); *B65D 81/3216* (2013.01)

(58) Field of Classification Search
CPC ..... B65D 81/3227; B65D 81/32; B65D 81/3216; B65D 21/0233; A47G 19/2205
(Continued)

(56) References Cited

U.S. PATENT DOCUMENTS 4,548,339 A * 10/1985 Gorman ..... A47J 41/0072 215/6
7,063,229 B2 * 6/2006 Westerhof ..... A47G 19/02 220/506

(Continued)

*Primary Examiner* — Shawn M Braden
(74) *Attorney, Agent, or Firm* — Mark C. Johnson; Johnson | Dalal

(57) ABSTRACT

A multi-chamber shot container including a hand-held body that defines a first aperture disposed at an upper end of the hand-held body, a second aperture, and an upper fluid aperture disposed at the upper end of the hand-held body, wherein the first aperture and the upper fluid aperture are disposed at the upper end of the hand-held body. The shot container also includes an inner container member with an inner surface and a bottom surface enclosing and defining a first cavity spanning from the bottom surface of the inner container member to the upper fluid aperture and an outer container member with an inner surface and a bottom surface enclosing and defining, with an outer surface of the inner container member, a second cavity liquidly segregated from the first cavity, wherein the first and second apertures are in sole fluid communication with the second cavity.

17 Claims, 4 Drawing Sheets

(58) Field of Classification Search
USPC ..... 220/506
See application file for complete search history.

(56) References Cited

U.S. PATENT DOCUMENTS

| | | | | |
|---|---|---|---|---|
| 8,690,015 | B2 | 4/2014 | Mainville et al. | |
| 9,038,845 | B1 * | 5/2015 | Buck | B65D 51/28 220/521 |
| 2004/0099544 | A1 * | 5/2004 | Ness | B65D 81/3227 206/216 |
| 2009/0026222 | A1 | 1/2009 | Seelhofer | |
| 2013/0240535 | A1 | 9/2013 | Grajqevci | |
| 2015/0000824 | A1 | 1/2015 | Osamura et al. | |

* cited by examiner

100

MULTI-CHAMBERED SHOT CONTAINER

CROSS-REFERENCE TO RELATED APPLICATION

This application is a national stage filing of International Application Number PCT/US16/35278, filed Jun. 1, 2016, which claims priority to U.S. Provisional Patent Application No. 62/168,947 filed Jun. 1, 2015, the entirety of which is incorporated herein by reference.

FIELD OF THE INVENTION

The present invention relates generally to hand-held drinking containers, and, more particularly, relates to hand-held multi-chambered drinking containers

BACKGROUND OF THE INVENTION

A multitude of Hand-held containers used to carry and drink liquid, such as water, soda, juice, and alcohol, are well known. Whether ranging from traditional plastic hand-held bottles having a cap that is screwed or twisted in an open or closed position, or plastic or metallic cans or cups, most of these containers do not enable users to segregate liquid contained therein, or enable users to sequentially or simultaneously discharge the segregated fluid effectively and efficiently. Many users desire sequential or simultaneous discharge or disbursement of segregated fluids for medicinal purposes (e.g., when a liquid medicinal solvent or solute is combined with a liquid non-medicinal liquid or solvent) or for flavor enhancement.

For example, some known dual-chambered drinking containers have dedicated spouts disposed at an end of the containers, wherein each of the spouts are respectively fluidly coupled each segregated fluid within the container. One such example can be found in U.S. Patent Application Publication No. 2008/00000866. These containers, however, make it difficult, if not impossible, to simultaneously discharge the contained fluid for consumption by the user in an effective manner. Moreover, these containers also require a user to apply a suction force to the spout or a compressive force to the container in order to discharge the fluid, which many users with physical impairments, such as respiratory complications or arthritis, find difficult if not impossible. Moreover, these containers are also less efficient in sequentially discharging fluids, as the user is required to reconfigure or reposition the container in order to permit discharge of the second contained and segregated liquid within the container.

Therefore, a need exists to overcome the problems with the prior art as discussed above.

SUMMARY OF THE INVENTION

The invention provides a multi-chambered shot container that overcomes the hereinafore-mentioned disadvantages of the heretofore-known devices and methods of this general type and that permits users an easy and effective way to sequentially or simultaneously discharge segregated liquids or fluids encapsulated within the container.

With the foregoing and other objects in view, there is provided, in accordance with the invention, a multi-chamber shot container that includes a hand-held inner container with a bottom surface, a lower end, and an upper end opposing the lower end, wherein the inner container defines a first aperture disposed at the upper end, defines a second aperture, and encloses and defines a first cavity extending from the bottom surface in a direction toward the upper end to define an upper fluid aperture disposed at the upper end. The upper fluid aperture is in liquid communication with the first cavity and the first and second apertures not in liquid communication with the first cavity. The container also includes a hand-held outer container having a lower end, an upper end opposing the lower end of the outer container, a bottom surface, and encloses and defines a second cavity extending from the bottom surface of the outer container in a direction toward the upper end of the outer container. The container also includes a first position along a container combination path with the inner container uncoupled with the outer container and a second position along the container combination path with the inner container disposed within the second cavity and removably coupled to the outer container in a watertight configuration that internally segregates the first cavity with respect to the second cavity, wherein the first and second apertures are in fluid communication with the second cavity.

In accordance with another feature, an embodiment of the present invention includes the inner container having a polymeric seal spanning a perimeter of an outer surface of the inner container (e.g., an o-ring), wherein the polymeric seal removably couples the inner container to the outer container when in the second position. The inner container may also have a flange spanning a perimeter of the inner container, wherein the flange is superimposed over the upper end of the outer container when in the second position along the container combination path.

In accordance with a further feature of the present invention, the second aperture is of an area less than an area of the first aperture and at most approximately 1 $in^2$.

In accordance with another feature of the present invention, the first and second apertures are disposed on opposing sides of the outer container, and the first aperture is upwardly facing in a longitudinal direction of the hand-held inner container and the second aperture is disposed in an orthogonal direction with respect to the longitudinal direction of the hand-held inner container.

In accordance with yet another feature of the present invention, the upper fluid aperture is interposed between the first and second apertures and the first and second cavities are concentrically disposed in relation to one another.

In accordance with a further feature of the present invention, the second aperture is defined by an outer side surface of the outer container.

In accordance with the present invention, a multi-chamber shot container has also been disclosed that includes a hand-held body with a lower end and an upper end opposite the lower end, wherein the body also defines a first aperture disposed at the upper end of the hand-held body, a second aperture, and an upper fluid aperture disposed at the upper end of the hand-held body, the first aperture and the upper fluid aperture disposed at the upper end of the hand-held body. The body may also include an inner container member with an inner surface and a bottom surface enclosing and defining a first cavity spanning from the bottom surface of the inner container member to the upper fluid aperture and may have an outer container member with an inner surface and a bottom surface enclosing and defining, with an outer surface of the inner container member, a second cavity liquidly segregated from the first cavity, wherein the first and second apertures are in sole fluid communication with the second cavity and the bottom surface of the inner container member in a raised position interposed between the bottom surface of the outer container and the upper end of the hand-held body.

In accordance with a further feature of the present invention, the second aperture is disposed at the upper end of the hand-held body and the first cavity and the second cavity are cylindrical and concentrically disposed in relation to one another.

In accordance with another feature, an embodiment of the present invention also includes the inner and outer container members being removably coupled to one another, and wherein there is a first position along a container combination path with the inner container member uncoupled with the outer container member and a second position along the container combination path with the inner container member disposed within the second cavity and removably coupled to the outer container in a watertight configuration and internally segregating the first cavity with respect to the second cavity.

In accordance with a further feature of the present invention, the first aperture is upwardly facing in a longitudinal direction of the hand-held body and the second aperture is disposed in an orthogonal direction with respect to the longitudinal direction of the body.

In accordance with another feature of the present invention, the first aperture has an area and the second aperture has an area, the area of the second aperture is of a magnitude less than a magnitude of the area of the first aperture. Moreover, the upper fluid aperture may also have an area, wherein the area of the upper fluid aperture is of a magnitude greater than the magnitudes of the areas of the first and second apertures.

Although the invention is illustrated and described herein as embodied in a multi-chambered shot container and method of use, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the bottom of the container to the top of the container.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

Figure 1:
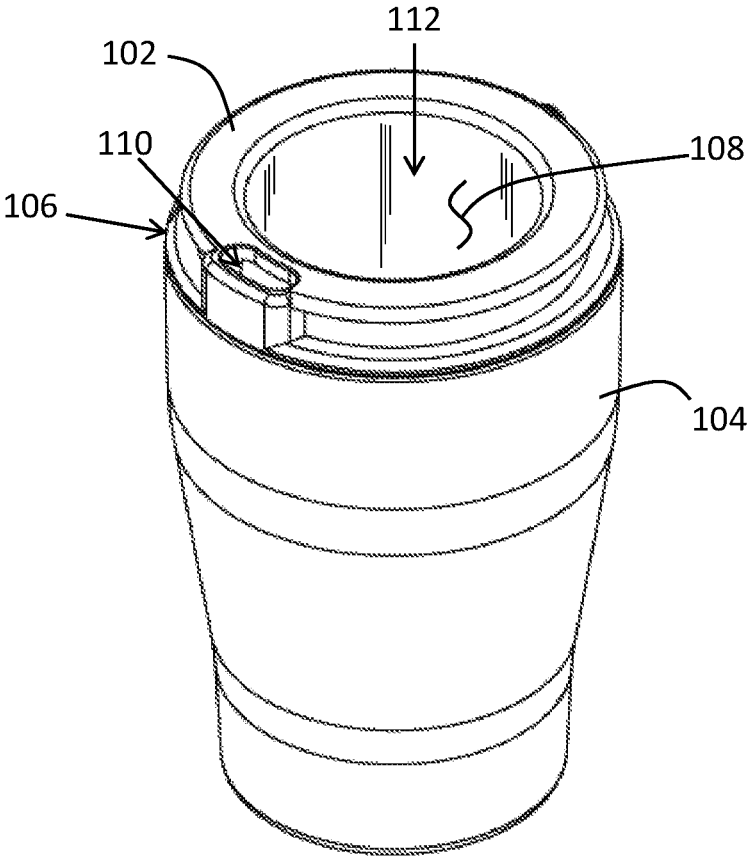
FIG. 1 is a perspective downward-looking view of a multi-chambered shot container in accordance with the present invention.

DETAILED DESCRIPTION OF THE INVENTION it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient multi-chambered shot container that permits effective and efficient dispersion (both sequentially and simultaneously) of segregated fluids therein. Embodiments of the invention also provide users an easy way to fill the chambers of the container by having sections of the container removably coupleable to each other in a fluidically sealed manner.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a multi-chambered 100 as shown in FIG. 1, includes an inner container 102 (also referred to herein as an "inner container member") and an outer container 104 (also referred to herein as an "outer container member"). The inner container 102, outer container 104, and body 106 may be described as being hand-held, or capable of being grasped by a user with one hand and carried. Said another way, the container 100 is portable. With brief reference to FIG. 5 in combination with FIG. 1, the container 100 is advantageous in that it permits one fluid to be contained within a first cavity 108 and another fluid to be contained within a second cavity 500 that is segregated from the first cavity 108 so that the fluids do not mix while contained within the container 100. More particularly, the container 100 beneficially enables users to simultaneously discharge the fluids within the container 100 or sequentially through the configuration of apertures 110 and 300 (depicted in FIG. 3). More specifically, in one method of use, the user will fill the cavities 108, 500 with a fluid, cover the aperture 300 with, for example, a user's finger, drink the fluid from within the first cavity 108, release or remove the user's finger from the aperture 300 causing the ambient pressure on the each of the apertures 110, 300 to equalize, thereby permitting the fluid within the second cavity 500 to flow from the first aperture 110 and enable the user to drink the fluid from the second cavity 500.

Figure 5:
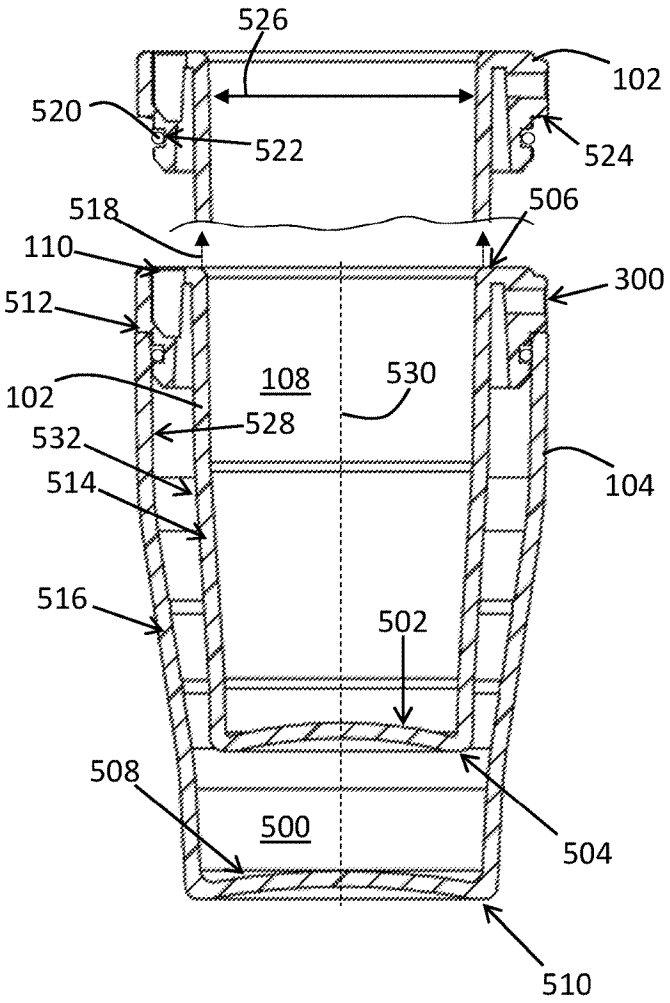
FIG. 5 is a cross-sectional view of the shot container along section line A-A depicted in FIG. 4.
Figure 4:
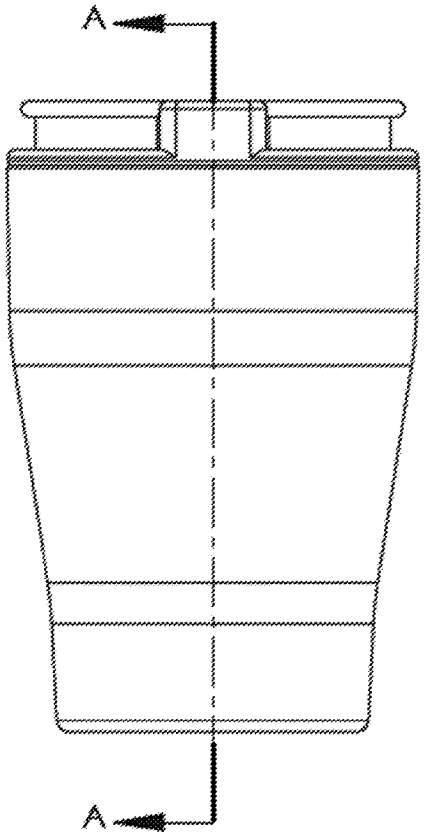
FIG. 4 is an elevational side front view of the shot container of FIG. 1.

With reference now to FIGS. 1 and 5, the inner container 102 includes a bottom surface 502, a lower end 504, and an upper end 506 opposing the lower end 504. The outer container 104 also includes a bottom surface 508, a lower end 510, and an upper end 512 opposing the lower end 510. The inner and outer containers 102, 104 also include respective sidewalls 514, 516 that enclose and define, with the respective bottom surfaces 502, 508, the respective first and second cavities 108, 500. The cavities 108, 500 are enclosed such that they are fluidly segregated from one another. Said a different way, the cavities 108, 500 are a fluidically sealed from one another by the sidewall 514 when the inner container 102 is disposed within the cavity 500 of the outer container 104. In one embodiment, the inner and outer containers 102, 104 are cylindrical. In other embodiments, the first and second cavities 108, 500 may be rectangular, triangular, or another shape that fulfills the advantageous method of dispersing fluid as described herein. The bottom surface 502 of the inner container member 102 can also be seen, when in the second position, in a raised position interposed between the bottom surface 508 of the outer container 104 and the upper end 506 of the hand-held body 106. Said another way, there is space between the bottom surfaces 502, 508 of the respective inner and outer container members 102, 104.

Figure 3:
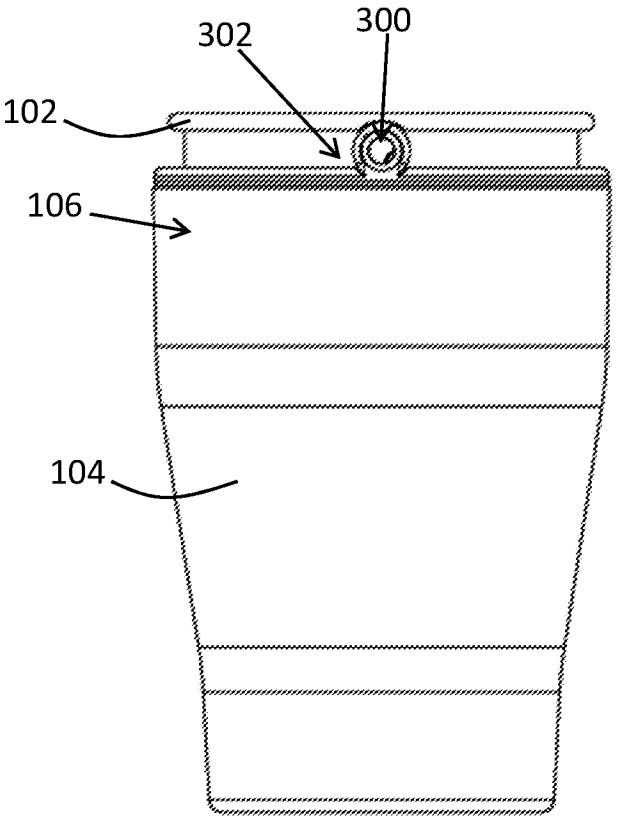
FIG. 3 is an elevational side rear view of the shot container of FIG. 1.
Figure 2:
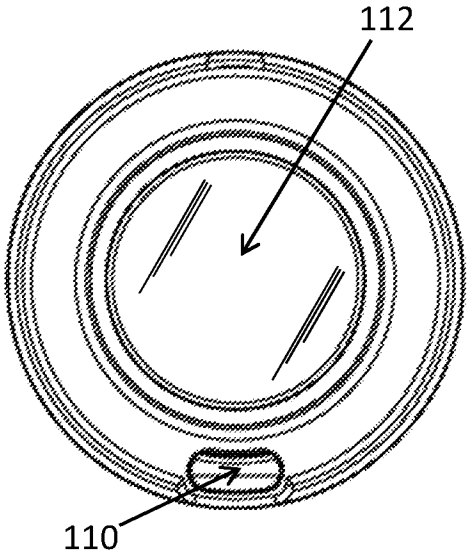
FIG. 2 is a top plan view of the shot container of FIG. 1.

To provide users the most effective and efficient dispersion of fluids within the cavities 108, 500, the first aperture 110 is disposed at the upper end 506 of the body 106 or, more particularly, at the upper end 506 of the inner container 102. The second aperture 300 may also be disposed at the upper end 506 to enable the user to quickly remove his or her finger or other object from over the second aperture 300 when the user desires to remove or disperse the fluid within the second cavity 500. When the apertures 110, 112, 300 are proximally (i.e., within approximately 5% of the overall length of the body 106) located at the upper end, they are still considered to be at the upper end for the purposes of this disclosure. The length of the inner and outer containers 102, 104 may range from 3-6 inches. With reference briefly to FIGS. 2 and 3, the second aperture 300 is preferably disposed on and defined by an outer side surface 302 of the body 106 (or inner container 102), and is on an opposing side of the body 106, as best shown in FIG. 2. The first aperture 110 is upwardly facing (i.e., towards the upper end 506) in a longitudinal direction of the body 106 and the second aperture 300 is disposed in an orthogonal direction with respect to the longitudinal direction of the body. Said another way, the first aperture 110 may be disposed facing the upper end of the body 106, while the second aperture 300 may face the side of the body 106 so the user can effectively disperse liquid and cover the second aperture 300 when the fluid within the second cavity is desired to be retained within. The first and second apertures 110, 300, along with an upper fluid aperture 112, are generally exposed to the ambient environment or, said another way, provide the ability for fluid communication between the outside ambient environment and the second cavity 500 and first cavity 108, respectively. In one embodiment, the first and second apertures 110, 300 are in sole fluid communication with the second cavity 500 to ensure there is no inadvertent undesired equalized pressure that would enable the undesired flow of fluid from the second cavity 500 to the first aperture 110. The upper fluid aperture 112 may also be advantageously interposed between the first and second apertures 110, 300 to provide the most effective configuration for sequential release of the fluid contained within the device 100.

In one embodiment, the apertures 110, 112, 300 are circular, in an oval shape, or other shape that permits the fluid to be effectively dispersed or, with regard to the second aperture, conducive to complete covering by a user's finger or hand. In one embodiment, the area of the second aperture 300 is approximately 0.05-0.25 $in^2$ and the area of the first aperture 110 is approximately 0.1-0.4 $in^2$. The second aperture 300 is of an area less than an area of the first aperture 110 and at most approximately 1 $in^2$ in one embodiment. The upper fluid aperture 112 may be of an area greater than both the first and second aperture areas, e.g., 4-6 $in^2$. As will be appreciated by a person of skill in the art, the aforementioned area ranges may vary based on the design and application constraints.

In certain embodiments of the present invention, the container 100 may utilize covers or caps to enable the container 100 to be transported without inadvertent discharge of any fluids contained therein. For example, the container 100 may utilize one or more valves, slideable covers, or other barriers disposed within the apertures 110, 112, 300 and operably configured to prevent egress or exiting of the fluid contained therein, unless desired by the user.

Beneficially, in one embodiment the inner container 102 is removably coupleable to the outer container 104 to quickly and effectively add a liquid to the second cavity 500. The multi-chambered shot container 100 can be said to have at least two positions along a container combination path (an exemplary path is represented with arrow 518). This path 518 may be linear in nature, or in a longitudinal direction of the container 100, or may have another path. The first position along the container combination path 518 (which is shown in the upper part of FIG. 5, for example) includes the inner container 102 uncoupled with the outer container 104. The second position along the container combination path 518 (which is shown in FIG. 1 and the lower part of FIG. 5, for example) include the inner container 102 disposed within the second cavity and removably coupled to the outer container 104 in a watertight configuration and internally segregating the first cavity 108 with respect to the second cavity 500 as described above. The configuration or connection between the inner and outer containers 102, 104 when in the second position may also be described has having a hermetically sealed configuration so as to inhibit the escape of both liquid and air from the inner cavity (other than through the apertures 110, 300).

The inner and outer containers 102, 104 may be removably coupled together using one or more polymeric seals, e.g., rubber seal 520, that spans a perimeter of an outer surface 522 of the inner container 102. Said differently, the rubber seal 520 surrounds the circumference of the outer surface 522 of the inner container 102. The polymeric seal 520 may be direct coupling contact between the inner and outer containers 102, 104, and provides an easy and effective way to remove and frictionally retain (when in the second position) the inner container 102 to the outer container 104. In other embodiments, the inner container 102 may use a tongue-and-groove configuration or other coupling mechanism to place the inner container 102 in a watertight configuration with the outer container 104.

The inner container 102 may also include a flange 524 that may span the perimeter (in whole in part) of the inner container 102 to provide a stop measure when inserting the inner container 102 within the cavity 500 of the outer container 104. In one embodiment, the flange 524 protrudes outwardly from the inner container 102 a length that equals the thickness of the sidewall 516 of the outer container 104 to provide a combined multi-chamber shot container 100 that is ergonomic and effective to handle. The flange 524 may also be of another dimension or configuration.

In another embodiment, a cross-sectional width (represented with arrow 526) of the inner container 102 is sized and shaped to be frictionally retained by a width separating two opposing inner surfaces 528 of the sidewall 516 of the outer container 104. Said another way, the width 526 of the inner container 102, along a portion of the longitudinal length of the inner container 102, is slightly less than the width of the cavity 500 width along a portion of the longitudinal length of the outer container 104. When installed in the second position, the flange 524 of the inner container 102 may be superimposed over or directly coupled to the upper end 512, or terminal end, of the outer container 104.

With reference back to FIGS. 1 and 5, the first cavity 108 can be seen extending from the bottom surface 502 in a direction toward the upper end 506 of the first container 102 to define the upper fluid aperture 112. As apparent from the figures, the upper fluid aperture 112 is in liquid communication with the first cavity 108 and the first and second apertures 110, 300 are not in liquid communication with the first cavity 108. The second cavity 500 is larger than the first cavity 108 to ensure there is sufficient space for fluid within the second cavity 500 after the first container 102 is inserted within the second container 104. The second cavity 500 extends from the bottom surface 508 of the outer container 104 in a direction toward the upper end 512 of the outer container 104. When the first and second containers 102, 104 are coupled together in the second position, like shown in FIG. 5, the second cavity 500 is also defined by the outer surface 532 of the first container 102. The first and second cavities 108, 500 may be capable of holding approximately 1.2-2.5 fl. oz. and 1.5-3.0 fl. oz., respectively. In other embodiments, the capacity of the cavities 108, 500 may vary outside of those ranges. To ensure alignment of the two containers 102, 104 when joined together and uniform distribution of the contained fluid within the second cavity 500, the first and second cavities are concentrically disposed in relation to one another. Said another way, they approximately share the same center about a center axis 530.

Figure 6:
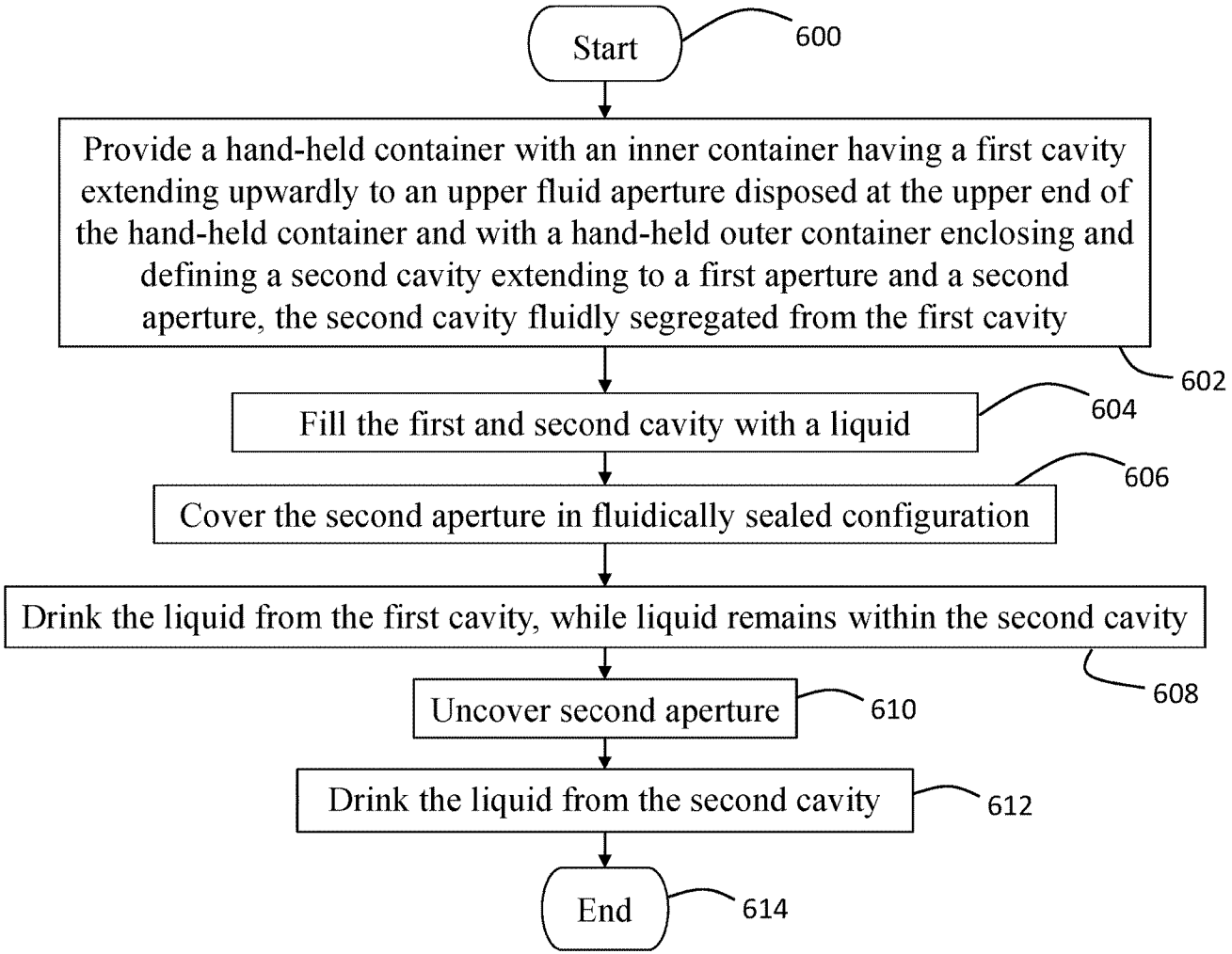
FIG. 6 depicts a process flow diagram of a method of dispensing two fluids sequentially within a multi-chambered shot container in accordance with the present invention.

FIG. 5 will now be described in conjunction with the process flow chart of FIG. 6. Although FIG. 6 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 6 for the sake of brevity. In some embodiments, some or all of the process steps included in FIG. 6 can be combined into a single process. The process begins at step 600 and immediately proceeds to step 602 of providing a hand-held container 100 with features and configurations described above. Step 604 includes filling the first and second cavities 108, 500 with a liquid, such as alcohol. In one embodiment, the first and second containers 102, 104 may be uncoupled from one another when filled. In other embodiments, they may be coupled to one another when being filled. When the container 100 permits uncoupling of the container members 102, 104, the members 102, 104 may still advantageously be operable to independently stand upright and contain liquid. When the containers 102, 104 are uncoupled with one another (i.e., the first position along the container combination path), the process will also include the user coupling the two containers 102, 104 in a watertight configuration (i.e., the second position along the container combination path).

Next, when sequential disbursement of the contained fluid is desired, the process continues to step 606 of covering the second aperture 300 in a fluidically sealed configuration so atmospheric pressure is exerted on the fluid within the second cavity 500 solely through the first aperture 110. The user may cover the second aperture 300 with his or her finger or other part of the user's hand. When simultaneous disbursement of the fluids is desired, the user will not cover the second aperture 300. Next, step 608 drinking the liquid from the first cavity 108, while the liquid in the second cavity 500 remains therein, due, again, to the pressure difference across the first aperture 110 and exerted on the liquid in the second cavity 500.

When the user desires disbursement of the second liquid within the second cavity 500, step 610 includes uncovering the second aperture 300 to equalize the pressure and permit flow of the liquid through first aperture 110. Step 612 includes drinking the liquid within the second container 104. The process ends at step 614.

A multi-chambered shot container and method of use has been disclosed that efficiently and effectively permits sequential or simultaneous dispersion of segregated liquids within a container.

What is claimed is:

1. A multi-chamber shot container comprising:

a hand-held inner container with a bottom surface, a lower end, and an upper end opposing the lower end, the inner container defining a first aperture disposed at the upper end, defining a second aperture on an outer side surface of the inner container, and enclosing and defining a first cavity extending from the bottom surface in a direction toward the upper end to define an upper fluid aperture disposed at the upper end, the upper fluid aperture in liquid communication with the first cavity and the first and second apertures not in liquid communication with the first cavity;

a hand-held outer container having a lower end, an upper end opposing the lower end of the outer container, a bottom surface, and enclosing and defining a second cavity extending from the bottom surface of the outer container in a direction toward the upper end of the outer container, on an outer side surface of the outer container;

a first position along a container combination path with the inner container uncoupled with the outer container; and a second position along the container combination path with the inner container disposed within the second cavity and removably coupled to the outer container in a watertight configuration and internally segregating the first cavity with respect to the second cavity, the first and second apertures in fluid communication with the second cavity and with the first aperture upwardly facing in a longitudinal direction of the hand-held inner container and with the second aperture disposed in an orthogonal direction with respect to the longitudinal direction of the hand-held inner container.

2. The multi-chamber shot container according to claim 1, wherein the inner container further comprises:

a polymeric seal spanning a perimeter of an outer surface of the inner container, wherein the polymeric seal removably couples the inner container to the outer container when in the second position along the container combination path.

3. The multi-chamber shot container according to claim 1, wherein the inner container further comprises:

a flange spanning a perimeter of the inner container, the flange superimposed over the upper end of the outer container when in the second position along the container combination path.

4. The multi-chamber shot container according to claim 1, wherein:

the second aperture is of an area less than an area of the first aperture and at most approximately 1 $in^2$.

5. The multi-chamber shot container according to claim 1, wherein:

the first and second apertures are disposed on opposing sides of the outer container.

6. The multi-chamber shot container according to claim 5, wherein:

the upper fluid aperture is interposed between the first and second apertures.

7. The multi-chamber shot container according to claim 1, wherein:

the first and second cavities are concentrically disposed in relation to one another.

8. A multi-chamber shot container comprising:

a hand-held body:

having a lower end and an upper end opposite the lower end;

defining a first aperture disposed at the upper end of the hand-held body, a second aperture, and an upper fluid aperture disposed at the upper end of the hand-held body, the first aperture and the upper fluid aperture disposed at the upper end of the hand-held body and the first aperture is upwardly facing in a longitudinal direction of the hand-held body and the second aperture is disposed in an orthogonal direction with respect to the longitudinal direction of the body;

having an inner container member with an inner surface and a bottom surface enclosing and defining a first cavity spanning from the bottom surface of the inner container member to the upper fluid aperture; and having an outer container member with an inner surface and a bottom surface enclosing and defining, with an outer surface of the inner container member, a second cavity liquidly segregated from the first cavity, the first and second apertures in sole fluid communication with the second cavity and the bottom surface of the inner container member in a raised position interposed between the bottom surface of the outer container and the upper end of the hand-held body.

9. The multi-chamber shot container according to claim 8, wherein:

the second aperture is disposed at the upper end of the hand-held body.

10. The multi-chamber shot container according to claim 8, wherein:

the first cavity and the second cavity are cylindrical and concentrically disposed in relation to one another.

11. The multi-chamber shot container according to claim 8, wherein the inner and outer container members are removably coupled to one another, and further comprising:

a first position along a container combination path with the inner container member uncoupled with the outer container member; and a second position along the container combination path with the inner container member disposed within the second cavity and removably coupled to the outer container in a watertight configuration and internally segregating the first cavity with respect to the second cavity.

12. The multi-chamber shot container according to claim 11, wherein the inner container member further comprises:

a polymeric seal spanning a perimeter of the outer surface of the inner container member, wherein the polymeric seal removably couples the inner container member to the outer container when in the second position along the container combination path.

13. The multi-chamber shot container according to claim 11, wherein the inner container member further comprises:

a flange spanning a perimeter of the inner container member, the flange superimposed over the upper end of the outer container member when in the second position along the container combination path.

14. The multi-chamber shot container according to claim 8, wherein:

the first aperture is upwardly facing in a longitudinal direction of the hand-held body and the second aperture is disposed in an orthogonal direction with respect to the longitudinal direction of the body.

15. The multi-chamber shot container according to claim 14, wherein:

the first aperture has an area and the second aperture has an area, the area of the second aperture is of a magnitude less than a magnitude of the area of the first aperture.

16. The multi-chamber shot container according to claim 15, wherein:

the upper fluid aperture has an area, the area of the upper fluid aperture is of a magnitude greater than the magnitudes of the areas of the first and second apertures.

17. A multi-chamber shot container comprising:

a hand-held inner container with a bottom surface, a lower end, and an upper end opposing the lower end, the inner container defining a first aperture disposed at the upper end, defining a second aperture on an outer side surface of the inner container, and enclosing and defining a first cavity extending from the bottom surface in a direction toward the upper end to define an upper fluid aperture disposed at the upper end, the upper fluid aperture in liquid communication with the first cavity and the first and second apertures not in liquid communication with the first cavity;

a hand-held outer container having a lower end, an upper end opposing the lower end of the outer container, a bottom surface, and enclosing and defining a second cavity extending from the bottom surface of the outer container in a direction toward the upper end of the outer container, on an outer side surface of the outer container;

a first position along a container combination path with the inner container uncoupled with the outer container; and a second position along the container combination path with the inner container disposed within the second cavity and removably coupled to the outer container in a watertight configuration and internally segregating the first cavity with respect to the second cavity, the first and second apertures in fluid communication with the second cavity and with the upper fluid aperture interposed between the first and second apertures.

* * * * *